United States Patent [19]

LaChapelle

[11] Patent Number: 4,491,255

[45] Date of Patent: Jan. 1, 1985

[54] COLLAPSIBLE HOSIERY FORM

[75] Inventor: Philip S. LaChapelle, Charlotte, N.C.

[73] Assignee: Intech Corporation, Charlotte, N.C.

[21] Appl. No.: 496,400

[22] Filed: May 20, 1983

[51] Int. Cl.[3] ..... D06C 15/00; D06H 3/16

[52] U.S. Cl. ..... 223/37; 233/76; 233/77; 233/112

[58] Field of Search ..... 223/37, 60, 66, 75, 223/76, 77, 112

[56] References Cited

U.S. PATENT DOCUMENTS

| | | | |
|---|---|---|---|
| 3,054,542 | 9/1962 | Glaze et al. | 223/112 |
| 3,686,726 | 8/1972 | Glaze et al. | 68/10 X |
| 3,704,565 | 12/1972 | Glaze | 223/75 X |
| 3,811,607 | 5/1974 | Glaze | 223/74 |
| 4,136,557 | 1/1979 | Bell | 223/77 X |
| 4,401,244 | 8/1983 | Selvi et al. | 223/77 X |
| 4,421,258 | 12/1983 | Safrit et al. | 223/75 |
| 4,434,918 | 3/1984 | Hodges | 223/75 |

FOREIGN PATENT DOCUMENTS

| | | | |
|---|---|---|---|
| 1096318 | 1/1961 | Fed. Rep. of Germany | 223/77 |
| 22629 | of 1894 | United Kingdom . | |

*Primary Examiner*—Louis K. Rimrodt

*Attorney, Agent, or Firm*—Banner, Birch, McKie & Beckett

[57] ABSTRACT

A collapsible hosiery form for panty hose garments and the like, suitable for hosiery handling apparatus in which a plurality of such forms are conveyed about an endless path from a loading station through a treatment chamber to a stripping station, includes a support base provided with means to mount the form on the conveyor of the hosiery handling apparatus. This hosiery form support base carries a pair of generally parallel garment shaping legs disposed so as to define a space between the legs and each leg includes first and second elongated members that are mounted for substantially translational relative movement so that the legs are shiftable between expanded and collapsed conditions. Garment fabric tucking elements are connected to shift relative to the legs so that these elements are disposed exteriorly of the space between the legs when the form is in the collapsed condition in order that a panty garment can be loaded onto and stripped from the form while these tucking elements shift into this space and thereby draw loose fabric into this space when the form is shifted into its expanded condition.

15 Claims, 13 Drawing Figures

FIG. 1.
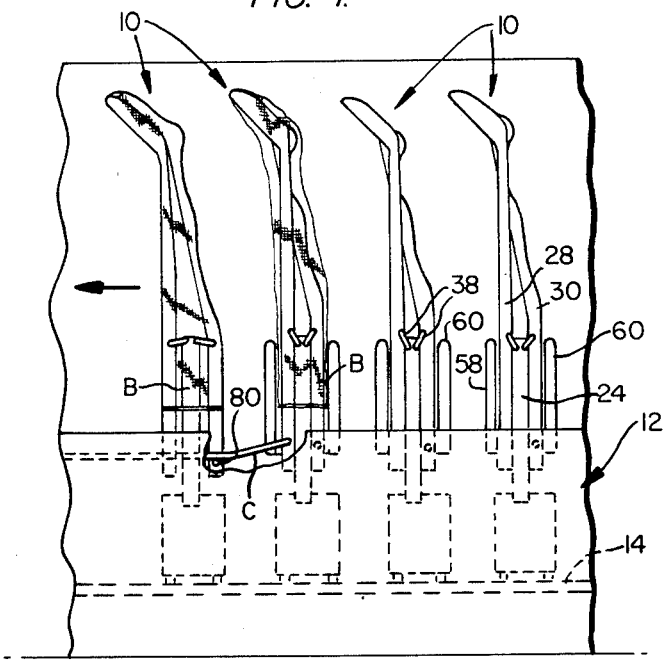
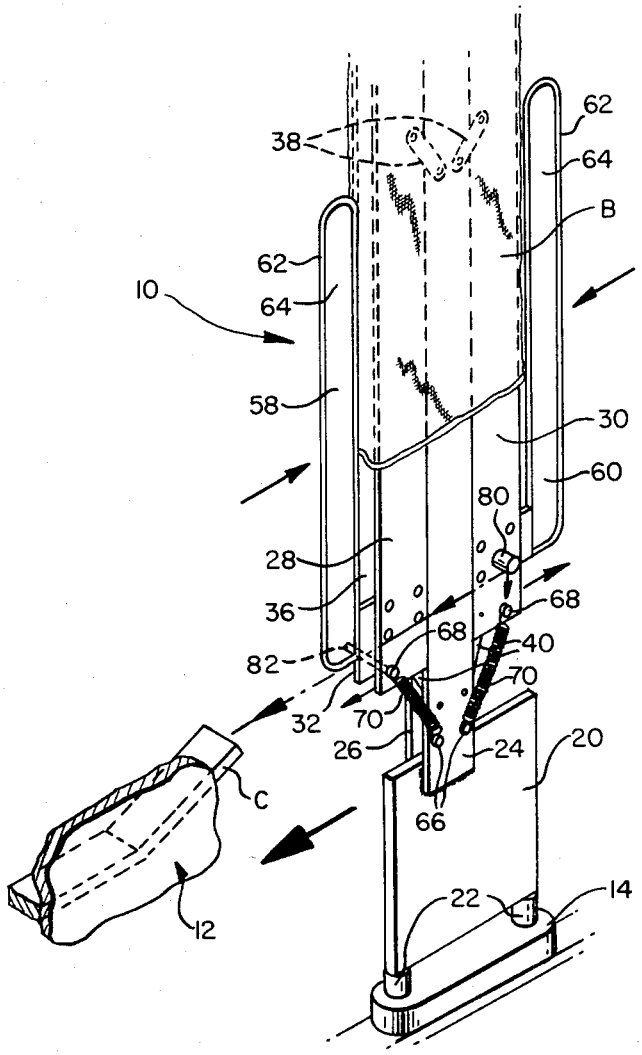
FIG. 13.

COLLAPSIBLE HOSIERY FORM

BACKGROUND OF THE INVENTION

This invention relates to an improved boarding form suitable for use in hosiery handling apparatus. The collapsible hosiery form is particularly advantageous for panty hose garments and the like in hosiery handling apparatus wherein such garments are mounted for fabric straightening or smoothing, inspection and treating immediately prior to being stripped from the form and packaged.

The collapsible hosiery form is especially useful in the processing of hosiery articles knit from synthetic stretch yarn and is particularly well-adapted to the processing of garments such as knit leotards, panty hose, tights, and the like, these garments collectively hereinafter being referred to generally as panty hose or panty garments.

The hosiery handling apparatus in which the collapsible hosiery form of this invention finds particular utility is exemplified by U.S. Pat. No. 3,704,565 to John W. Glaze, Jr. and U.S. Pat. No. 3,054,542 to John W. Glaze, Jr. et al. Such apparatus is generally characterized by a plurality of hosiery forms being conveyed about an endless path from a loading station through a treatment chamber to a stripping station, the treated garment being stripped from the forms at this latter station and characteristically either stacked or supplied directly to appropriate packaging equipment.

Whereas the advent of super stretch synthetic yarns revolutionized the hosiery industry in making possible reduction in the number of sizes of stockings produced or eliminating sizing entirely by making a single-sized, fit-all garment, the introduction of panty hose or panty garments has also necessitated many changes in the methods and procedures employed in the production, packaging and marketing of these panty hose or panty garments.

Conventional hosiery boarding operations, essential prior to the introduction of super stretch yarns, cannot be employed in the production of stockings knit from synthetic stretch yarns because the conventional boarding process either destroys or greatly impairs the stretch quality of the fabric knitted from the super stretch yarn. The elimination of the conventional boarding operation greatly complicated the packaging operation since unboarded garments lacked the finished, smooth appearance imparted by the boarding operation. Thus, it was difficult to insert these unboarded garments into a conventional flat package. For example, super stretch synthetic yarn garments must be treated, inspected, transferred and packaged in a manner that will not unduly stretch the garment. Otherwise the garment would become misshapen if stretched beyond its elastic limits. On the other hand, the garment articles also must be flattened or smoothed and shaped to such a degree as to be easily packaged so they may present an attractive appearance to the purchaser upon removal from such package.

Thus, the prior art in developing hosiery forms utilizable in hosiery handling apparatus such as described in the above-mentioned patents, has proposed hosiery forms such as disclosed in John W. Glaze, Jr. U.S. Pat. No. 3,811,607. The hosiery form of this patent effectively enables the hosiery article to be temporarily mounted thereon for straightening, inspecting, treating and conveying through the hosiery handling apparatus.

By utilizing hosiery forms in accordance with U.S. Pat. No. 3,811,607 a so-called semiboarding of the hosiery is achieved. The term semi-boarding is employed to denote a process in which hosiery articles, including panty hose, are temporarily boarded or mounted on the boarding form for such time as it takes to straighten and flatten the hosiery article to eliminate the excess wrinkles, to inspect the article and to treat by processes such as heat treating. The semiboarding carried out on the hosiery form of this prior patent only slightly stretches and shapes the garment. On the hosiery form of this earlier patent, the garment as carried by the expanded form is passed before an illuminated screen or viewing panel which permits easy and efficient inspection of the garment before it passes into a treatment chamber. In such chamber sufficient heat is applied to dry the damp garment and to eliminate wrinkles and substantially set the garment to the smooth, flat shape of the hosiery form without relaxing the yarn sufficiently to materially effect its stretch quality. Upon leaving the treatment chamber, the form is automatically collapsed and the treated garment can be automatically stripped from the form by a pneumatic stripper and thereafter conveyed to a stacking machine or to an automatic packaging machine.

With the rapid increase in the popularity of panty hose or panty garments, prior art collapsible hosiery forms have not been entirely satisfactory in accomplishing garment treatment to obtain the desired entire smooth, flat shape of the panty hose garment when treated on these forms. Whereas the leg portions of the panty garment can be effectively smoothly shaped utilizing prior art hosiery forms, the body portion of the panty garment, namely, that portion which encircles the body of the wearer that is connected to the leg portions of the garment may not always be produced with the desired smoothness or flatness desired for the attractive appearance to the purchaser upon removal of the panty garment from its package.

This failure to effectively smooth or flatten the body encircling portion of the panty garment stems from the fact that prior art collapsible hosiery forms generally are not effective in accommodating the excess or loose fabric material which forms the body portion of the panty garment. In effect, prior hosiery forms tend to leave this loose fabric which forms the body portion of the panty garment in an unsmoothed condition as the form carrying the garment is conveyed through the hosiery handling apparatus where the garment receives the needed treatment to render the desired attractive smooth appearance and flat shape to be seen by the purchaser of the garment upon removal from the garment's package.

SUMMARY OF THE INVENTION

With the above background in mind, it is a primary object of the present invention to provide an improved collapsible hosiery form upon which hosiery articles can be temporarily mounted for straightening, inspecting, treating and final collection or packaging in a smooth, flat shape that is particularly adapted to the handling of panty hose or panty garments, these garments including a pair of leg portions as well as a body encircling portion.

An important object of the invention is the provision of an expandable and collapsible hosiery form having spaced parallel garment shaping legs and garment fabric tucking means associated with these legs to draw loose fabric into the space between the legs where such loose fabric constitutes the body encircling portion of the garment as found in panty hose.

A further object of the invention is the provision of a collapsible hosiery form including in addition to parallel garment shaping legs a pair of tucking or crotch rod elements which are associated with the leg members of the hosiery form such that in the form's being shifted between expanded and collapsed conditions these elements move into and thereby draw loose fabric into the space between the parallel legs such that this loose fabric usually forming the body encircling portion of the panty garment will be slightly stretched into a smooth, flat shape whereby the final treated garment, once removed from the hosiery form, will have a smooth unwrinkled attractive appearance to the purchaser upon removal from the panty hose package.

The collapsible hosiery form invention herein may be generally summarized as comprising a form support base that is supported on support pins permitting a plurality of such forms to be mounted on the conveying chain of an appropriate hosiery handling apparatus. The hosiery form includes a pair of generally parallel garment shaping legs extending in spaced relation from the support base with each leg including first and second elongated slender members which are mounted to be shiftable with translational relative movement between expanded and collapsed conditions for each leg. The hosiery form further comprises fabric tucking elements connected to shift relative to the parallel legs of the form so that these tucking or crotch rod elements are disposed exteriorly of the space between the form legs when the form is in collapsed condition in order that a panty garment can be loaded onto and stripped from the hosiery form while these tucking or crotch rod elements shift into the space between the garment shaping legs and thereby draw loose fabric from the body encircling portion of the garment into the space between the form legs when the form is shifted into its expanded condition.

Whereas other objects and advantages of the invention will become apparent from the following description of a preferred embodiment of the invention, the above may be considered as a general summarization of such invention.

BRIEF DESCRIPTION OF THE DRAWINGS

Detailed explanation of a preferred embodiment may be best understood from the following detailed description of the invention taken with the accompanying drawings in which:

FIG. 1 is a front elevation of a segment of a hosiery handling apparatus showing four collapsible hosiery forms in accordance with the invention operatively associated to move in the endless conveying path of such apparatus.

FIG. 13 is a fragmentary perspective view showing a collapsed hosiery form supported on the hosiery handling apparatus conveyor as it approaches a stationary operating cam on such apparatus.

DESCRIPTION OF A PREFERRED EMBODIMENT

Figure 2:
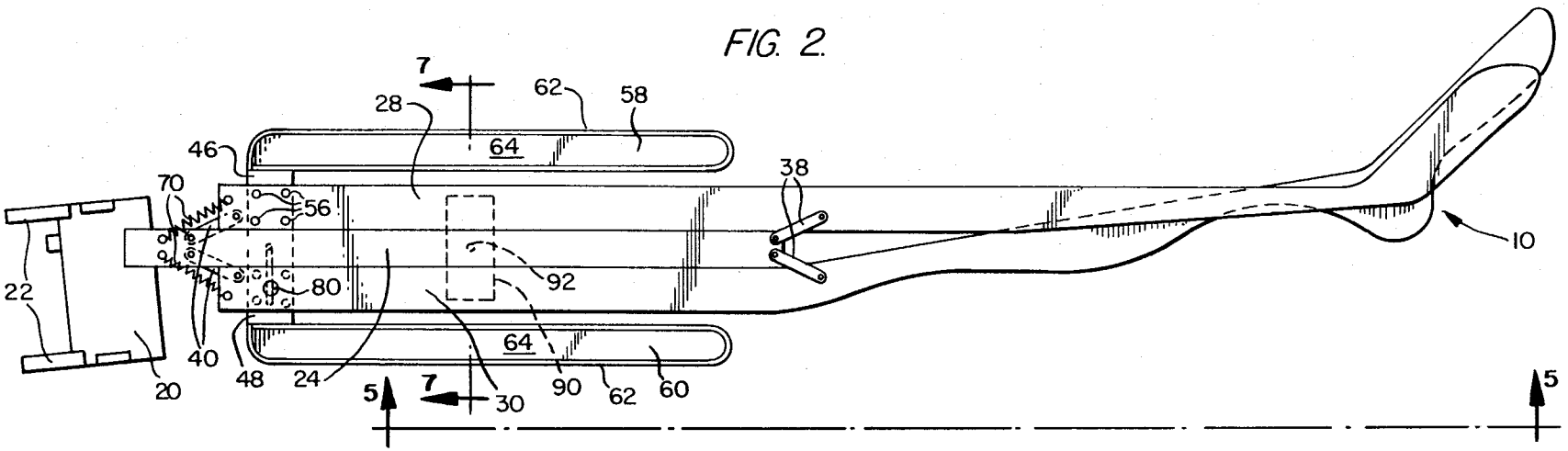
FIG. 2 is a side elevation of a collapsed hosiery form in accordance with the invention.

On the drawings, FIG. 1 diagrammatically illustrates four collapsible hosiery forms 10 mounted to move along a segment of the endless conveying path in succession through appropriate hosiery handling apparatus 12. Such a hosiery handling apparatus 12 is conventionally provided with a chain link conveyor 14. The chain links can be connected by tubular pin members which receive the mounting pins 22 on the support base 20 of the hosiery form 10 in mounting such form on the conveyor 14. Thus, a plurality of collapsible hosiery forms 10 are conveyed in the hosiery handling apparatus about an endless path commencing with a loading station, continuing through a treatment chamber to a stripping station and thereafter return to the loading station.

The constructional details of the particular hosiery handling apparatus 12 are not considered to be part of the collapsible hosiery form invention. Generally, these details may be found exemplified in the disclosure of the above-mentioned John W. Glaze, Jr. U.S. Pat. No. 3,704,565 issued Dec. 5, 1972. Accordingly, the disclosure of this patent is considered incorporated by reference as exemplifying a suitable hosiery handling apparatus 12 within which a plurality of the collapsible hosiery forms 10 forming the instant invention may be effectively employed.

It may be briefly mentioned that under the disclosure of this earlier patent, the panty hose or panty garments are successively loaded on hosiery forms whereafter the frames are expanded to slightly stretch the garments to flatten the legs and body portion, and to remove any wrinkles therefrom. The expanded forms then pass before an illuminated inspection screen to permit the loading operator to inspect the garments for any defects. After the panty hose has been inspected on the hosiery forms, the forms are conveyed by the endless chain, such as 14 in apparatus 12 as shown on FIG. 1 herein, through a conventional treatment chamber where heated air dries the garments and tends to set them in their slightly expanded or stretched condition so that, when removed, the panty hose may be laid flat without excessive effort being required to straighten and remove wrinkles therefrom.

Whereas the hosiery handling apparatus 12 incorporating the chain conveyor 14 partially illustrated on FIGS. 1 and 13 of the drawings in this application is not deemed a part of the invention herein, it is to be noted that such an apparatus 12 will advantageously provide stationary cam means such as the cam C shown in FIGS. 1 and 13 mounted on the hosiery handling apparatus 12 so as to be disposed in the path of movement of the hosiery forms 10 as they progress with the conveyor 14 past the loading station, treatment chamber, stripping station, etc. Thus, stationary cams C are positioned in apparatus 12 to interact with actuating pins appropriately located on components of the collapsible hosiery forms 10 all as will be explained in more detail hereinafter in relation to the structure of these hosiery forms 10.

Reference may now be made to the constructional features of the collapsible hosiery form 10. Each form 10 has a support base 20 shown in the form of a flat plate carrying downwardly projecting parallel mounting pins 22 which serve to support the form on the conveyor chain 14 of the hosiery handling apparatus 12. This base 20 has a central support extending upwardly therefrom generally opposite to the direction of mounting pins 22, this central support being formed by support rails 24 and 26 having their lower ends suitably welded to the opposed faces of the plate part of base 20. This relation between rails 24 and 26 forms the central support of the hosiery form base with an aperture that conveniently enables housing other parts of the collapsible hosiery form 10 in a manner that will be hereinafter described.

A pair of spaced generally parallel garment shaping legs extend from the base 20 along the opposite sides of the central support provided by support rails 24 and 26. Each of these legs includes first and second slender elongated members. Thus, one of the pair of legs is defined by a first member 28 and a second member 30. Likewise, the other of the pair of legs is formed by a first member 32 and a second member 34. Further, a space 36 is defined between the pair of legs.

Figure 3:
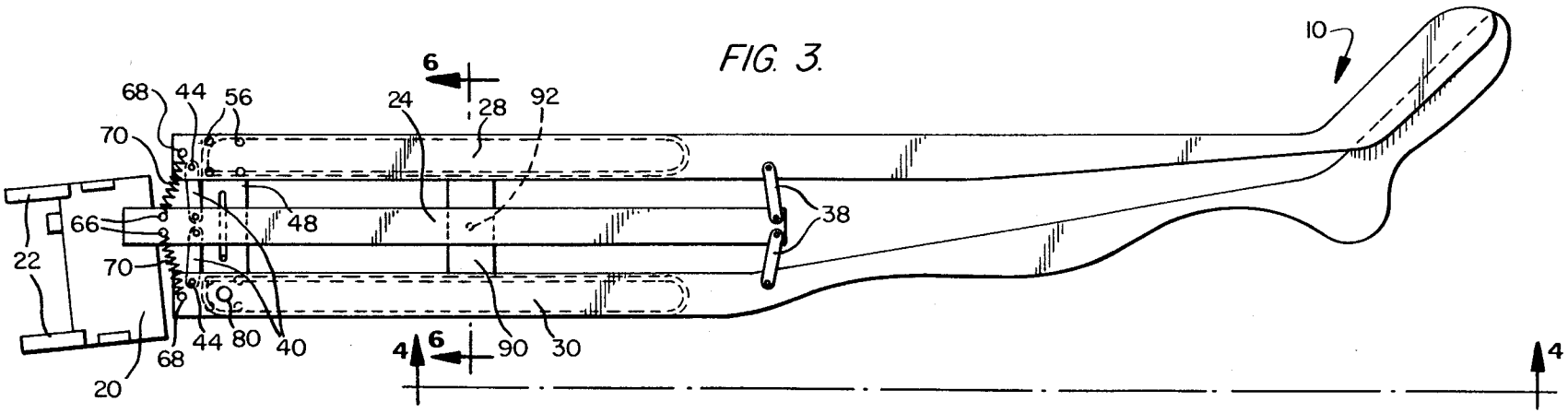
FIG. 3 is a side elevational view of the hosiery form of FIG. 2 shown in expanded condition.

As may be best seen from FIGS. 1–3, the contour of the upwardly extending slender portions of the first and second elongated members defining each of the pair of the garment shaping legs is shaped so that in the collapsed condition of these portions of the leg members such as shown in FIG. 2, a leg portion of the panty hose garment may be easily telescoped over these portions. Likewise, in the expanded condition of the leg where the first and second elongated members are disposed such as shown in FIG. 3, the contours of the upper slender portions of these members expand to slightly stretch and smooth out the garment leg portion that has been telescoped over these leg members.

On FIG. 1 the three hosiery forms 10 supported to the right on the conveyor 14 of apparatus 12 are collapsed while the leftward hosiery form 10 is shown in expanded condition. Further, on FIG. 1 the two rightward forms 10 have not yet been loaded with a panty hose garment. The third form from the right has the garment loosely telescoped over the form while still in collapsed condition. The fourth hosiery form 10 from the right has the panty hose garment with the form expanded such that the leg portions are smoothly stretched over the slender portions of the leg members spaced in the relation as form 10 is shown on FIG. 3.

Thus, it will be seen that the leading edge portions of the first elongated members 28 and 32 have an essentially straight contour where they would shape the shin portion of a wearer's leg with the top curved forwardly to form the top of the wearer's foot. By the same token, the trailing edge portions of the second elongated members 30 and 34 have a contoured shaped approximately outlining a wearer's calf, ankle and heel of the foot.

Figure 4:
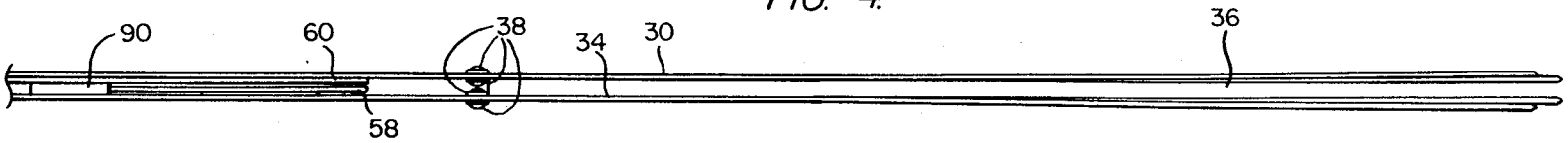
FIG. 4 is an end elevation taken on line 4—4 of FIG. 3.
Figure 5:
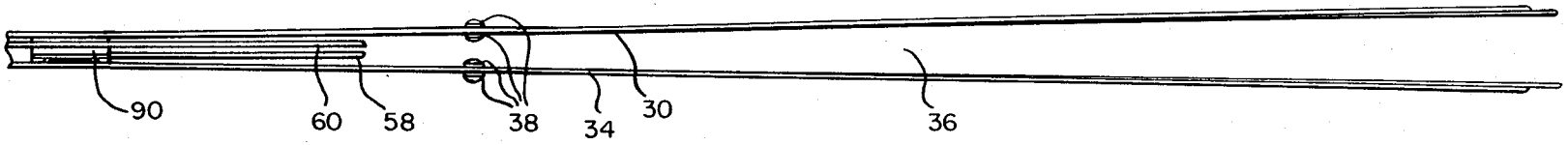
FIG. 5 is an end elevation taken on line 5—5 of FIG. 2.

As will be apparent from FIG. 4, the individual leg members 28, 30, 32 and 34 have a flat dimension in the general plane of the hosiery form 10 with the first and second members making up one of the garment shaping legs being parallel and spaced from the first and second members making up the other of the garment shaping legs. Further, as may be best seen from FIGS. 2 and 3, these flat portions of the leg members overlap one another adjacent the upper ends thereof. This facilitates the leg members smoothly sliding to overlie one another in the collapsed condition of the hosiery form 10 as shown in FIG. 2 whereas a lesser overlap exists when the hosiery form is shifted to its expanded condition as shown in FIG. 3.

As described above, the mating of first and second elongated members forming each of the pair of legs defines a space 36 between these legs. In loading a panty hose garment onto the hosiery form 10 when in its collapsed condition as shown on FIG. 2, the operator telescopes one garment leg over each of the pair of garment shaping legs of the form 10. In performing this loading operation, the body portion of the garment is drawn down to encircle both of the pair of legs with the crotch of the panty hose garment passing down within the space 36 defined between such legs.

While still in the collapsed condition, this disposes the panty hose garment as generally illustrated on the form 10 located second from the left on FIG. 1. FIG. 13 shows the body portion of the garment as it completely encircles the pair of legs carried by the hosiery form support base 20. Then, when the hosiery form 10 is shifted to its expanded condition the panty hose garment assumes the position generally illustrated on the leftward form 10 on FIG. 1 wherein loose fabric forming the body portion of the panty garment leading to the garment crotch is drawn into the space 36 between the parallel garment shaping legs by fabric tucking or crotch rod elements as will be described in detail hereinafter.

The first and second elongated members forming each of the pair of garment shaping legs are mounted on the central support provided by support rails 24 and 26 of base 20 so that these members undergo substantially translational movement relative to each other in moving between the expanded and collapsed conditions for the individual legs. To constrain these leg members to undergo this translational movement relative to the central support of rails 24 and 26, pairs of links 38 have their ends pivotally connected to the upper ends of the central support rails 24 and 26. The opposite ends of these pairs of links 38 are pivotally connected to the first and second elongated members defining the garment shaping legs. Thus, a pair of links 38 are pivotally connected between the upper end of central support rail 24 and first leg member 28 and a similar pair of links 38 are pivotally connected between the upper end of central support rail 24 and the second elongated member 30. The other first and second members 32 and 34 of the second leg are likewise connected to the upper end of central support rail 26 by individual pairs of links 38.

Whereas four pairs of links 38 have been described and illustrated as indicated on FIG. 4, it will be recognized that single links 38 may be easily employed to connect each leg member to its appropriate central support rail 24 or 26. It also will be understood that the pivotal connections at the ends of each link 38 may easily be formed by a smooth headed rivet-type fastener, this being important to minimize possible snagging of the panty garment when it is loaded onto the hosiery form 10 by being telescoped down over the spaced garment shaping legs defined by the members 28, 30, 32 and 34.

To complete the mounting of the leg members 28–34 so they are constrained to undergo translational movement relative to the support rails 24 and 26 of the central support, the lower ends of these leg members are connected by links 40 to the central support of base 20. This structure of the hosiery form 10 may best be seen on FIGS. 9–11.

Figure 11:
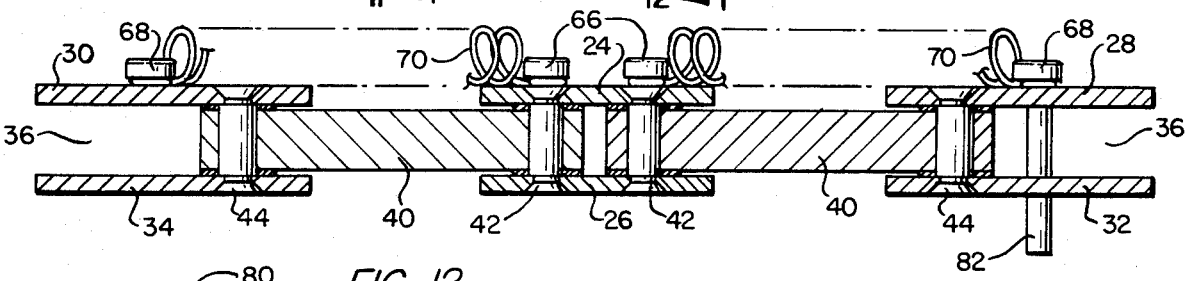
FIG. 11 is a sectional view taken on line 11—11 of FIG. 10.

Thus, a pair of links 40 each have their inner ends pivotally connected by rivets 42 to the rails 24 and 26 of the central support on base 20, these inner ends lying between the rails 24 and 26 as best seen in section on FIG. 11. The outer ends of links 40 are pivotally connected, as by suitable rivets 44, one link 40 being pivotally connected to the lower ends of first leg members 28 and 32 where the link 40 enters the space 36 between the legs and the other link 40 being pivotally connected to the second leg members 30 and 34 where this link enters the space 36 between these leg members.

It will thus be seen that by utilization of similar length connecting links 38 and 40 the mounting of the first and second members of each leg on the rails 24 and 26 of the central support on base 20 constrains these members to undergo translational movement relative to this central support as the hosiery form is shifted between expanded and collapsed conditions.

Figure 12:
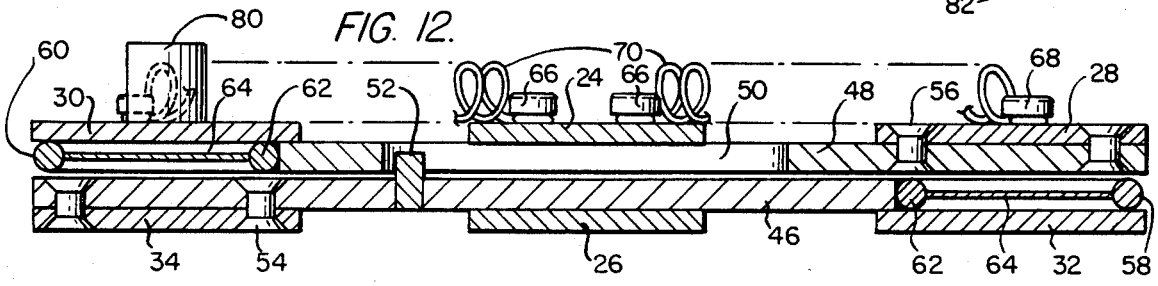
FIG. 12 is a sectional view taken on line 12—12 of FIG. 10.

As previously described, the central support of base 20 is provided by upstanding rails 24 and 26 appropriately welded to the plate of base 20. Thus, these rails define therebetween an aperture in the central support. As best seen on FIG. 12, a pair of guide plates 46 and 48 extend through this aperture. Plate 48 is provided with an elongated guide slot 50 while plate 46 carries a guide stud 52, this guide stud being engaged in the slot 50 so that controlled sliding movement between the plates 46 and 48 during expansion and collapse of the hosiery form is assured.

One end of guide plate 46 is suitably secured as by rivets 54 to the second leg member 34 of one of the garment shaping legs. Likewise, one end of guide plate 48 is suitably secured as by rivets 56 to the first leg member 28 of the other garment shaping leg. Thus, incident collapse and expansion of the hosiery form by shifting the leg members 28–34 between their collapsed positions shown on FIG. 2 and expanded positions shown on FIG. 3, the two guide plates 46 and 48 slide relative to each other with stud 52 in plate 46 moving longitudinally within slot 50 in plate 48.

Each of plates 46 and 48 has a garment fabric tucking means secured to the outer free end of such plate so as to move with the particular elongated leg member that the plate is riveted to. Thus, a tucking or crotch rod element 58 is suitably welded to the end of guide plate 46 and a tucking or crotch rod element 60 welded to the end of guide plate 48. The tucking elements 58 and 60 are secured to the ends of guide plates 48 and 46, respectively, so that these elements extend generally parallel to the elongated leg members that form the garment shaping legs.

In the form illustrated on the drawings, each of the tucking or crotch rod elements 58 and 60 is formed by an oblong cylindrical wire frame 62 with the interior of this frame closed by a sheet 64. The wire frame 62 is then welded to the end of the appropriate guide plate 46 or 48 in affixing the tucking element in its upstanding position relative to the members of the garment shaping legs in the hosiery form 10. The cylindrical wire frame 62 offers smooth rounded surfaces to avoid snagging the knitted panty garment material incident its loading and stripping from the hosiery form. However, it will be readily recognized that the tucking or crotch rod elements may be constructed in a variety of manners other than that specifically illustrated and described herein.

From the above description of the mounting for the tucking elements 58 and 60 on the guide plates 46 and 48, respectively, the functioning of these tucking or crotch rod elements to draw loose fabric into the space 36 between the parallel garment shaping legs that is present in the body portion of the panty garment will be apparent.

Figure 9:
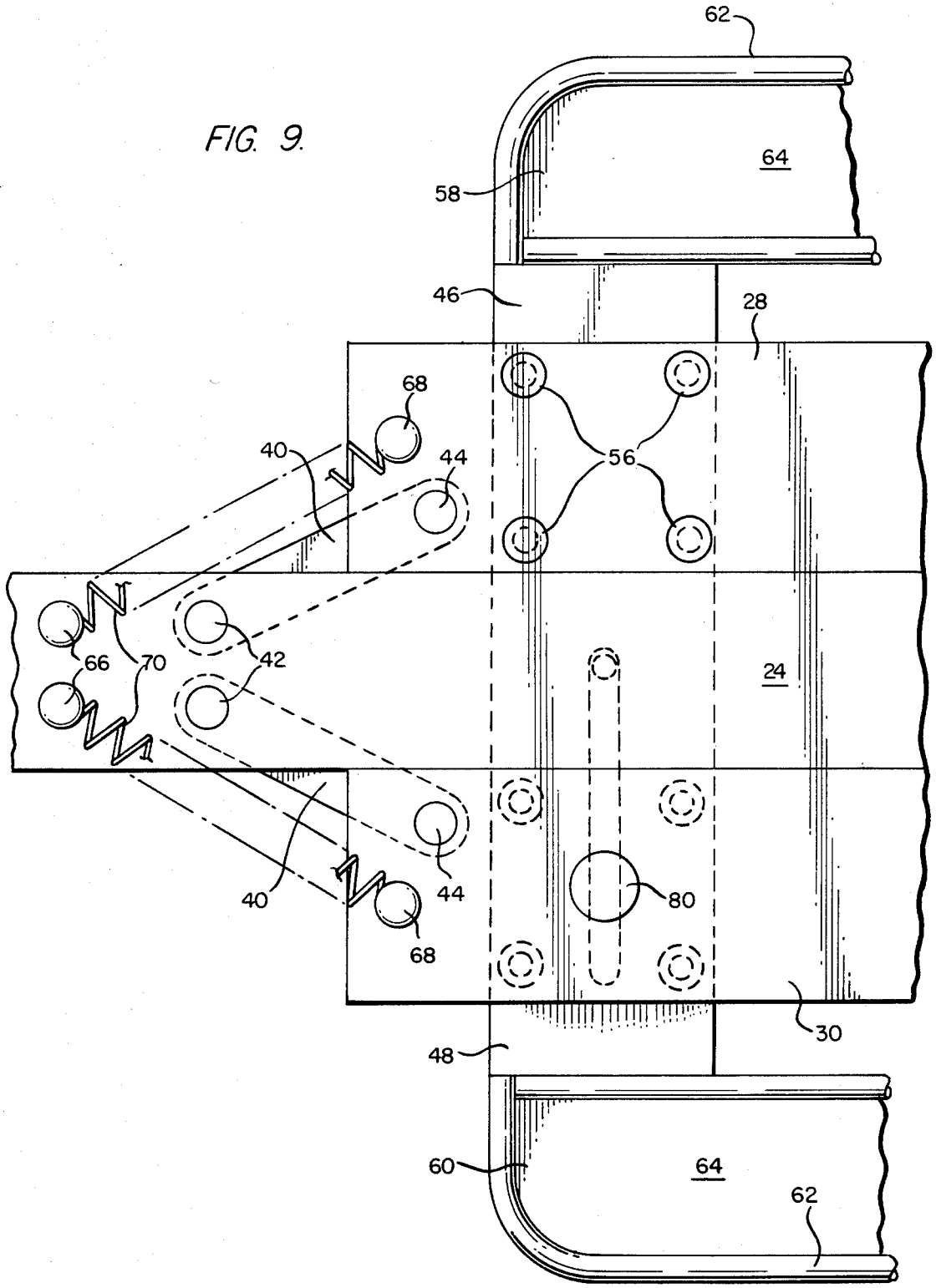
FIG. 9 is an enlarged side elevation of a segment of the hosiery form of FIG. 2 in collapsed condition.

FIGS. 2, 9 and 13 display the hosiery form 10 in collapsed condition. Likewise the three rightward forms 10 on FIG. 1 are in collapsed condition. In this collapsed condition the leg members 28–34 are engaged with the opposite sides of the rails 24 and 26 of the central support on base 20. Also the tucking or crotch rod elements 58 and 60 extend parallel and are spaced outwardly of the members making up the garment shaping legs. Thus, when the panty garment is loaded onto the hosiery form 10 in its collapsed condition with the garment legs being telescoped down over the separate garment shaping legs of the form, the body portion B of the garment, ending at the garment crotch, passes downwardly encircling both of the garment shaping legs of the hosiery form 10. In so doing, this garment body portion B moves inwardly of the two tucking elements 58 and 60 assuming the position illustrated on FIG. 9 and shown on the hosiery form 10 disposed second from the left on FIG. 1.

In the above described positioning of the panty garment on the collapsed hosiery form 10 excess loose garment fabric making up the body portion B of the panty garment will extend across or bridge the space 36 defined between the garment shaping legs of the hosiery form. Then by simply shifting the hosiery form 10 from its collapsed condition to its expanded condition the tucking or crotch rod elements 58 and 60 are automatically shifted into the space 36 disposed between the garment shaping legs, this automatic shifting occurring simply by reason of the elongated members 28, 30, 32 and 34 moving through the translational movement relative to each other under control of the mounting links 38 and 40 supporting these members on the central support rails 24 and 26 of the hosiery form support base 20. This action of expanding the hosiery form tucks the loose fabric into the space 36 between the garment shaping legs, drawing the fabric of body portion of the garment into smooth wrinkle-free, slightly stretched condition.

With each successive loading of a panty hose garment on a hosiery form 10 in accordance with the above procedures the expanded forms carrying these garments proceed successively through the hosiery handling apparatus in accordance with techniques and operations known in the prior art.

In the collapsed condition of hosiery form 10 the leg members 28–34 are limited in their inward movement relative to each other by their coming to rest against the opposite sides of the central support rails 24 and 26. This effectively defines the collapsed condition of the hosiery form 10 whereat the tucking or crotch rod elements 58 and 60 are disposed spaced outwardly of the upstanding sides of the leg members as shown in FIG. 2.

The expanded condition of the hosiery form 10 is effectively limited by the inner ends of links 40 which are pivotally connected between the central support rail members 24 and 26 by rivets 42. These inner ends of links 40 come into engagement with the underside of the guide rails 46 and 48. This limiting relationship is best seen on FIGS. 3 and 6. In this condition the leg members 28–34 have moved downwardly and outwardly to the expanded condition of the hosiery form 10. With the guide plates 46 and 48 carrying the tucking elements 58 and 60, respectively, and these guide plates being affixed to leg members at opposite sides of the central support rails 24 and 26, the tucking elements 58 and 60 have now moved into the space 36 defined between the garment shaping legs made up by members 28–34.

In the embodiment illustrated the downward and outward movement of leg members 28–34 is stopped by the underside of guide plates 46 and 40 coming into contact with the inner ends of links 40. As will be clear from FIGS. 3 and 10, this downward limited position disposes the links 40 slightly over center with reference to a line extending through the axes of rivets 44 that affix the outer ends of links 40 to the leg members. This over center condition is advantageous in relation to the tension spring biasing means described hereinafter.

In the embodiment of hosiery form 10 illustrated by way of example, the upstanding rail 24 of the central support on the form support base 20 is provided with a pair of pins 66. Likewise a pin 68 is provided extending outwardly at the lower end of each of the first and second leg members 28 and 30. A pair of tension springs 70 are provided, each spring having one end secured to a pin 66 and the opposite end secured to a pin 68. These springs 70 thus provide biasing forces acting to alternatively expand or collapse the hosiery form 10.

Whereas for convenience in illustration, the springs 70 with their supporting pins 66 and 68 have been illustrated as exposed externally on one face of the collapsible hosiery form 10, it is to be understood that these biasing springs 70 may advantageously be positioned intermediate the spaced leg members 28 and 32, and 30 and 34 to extend between the central support rails 24 and 26 so that they are housed in a more protected and unexposed location within the hosiery form 10.

Figure 10:
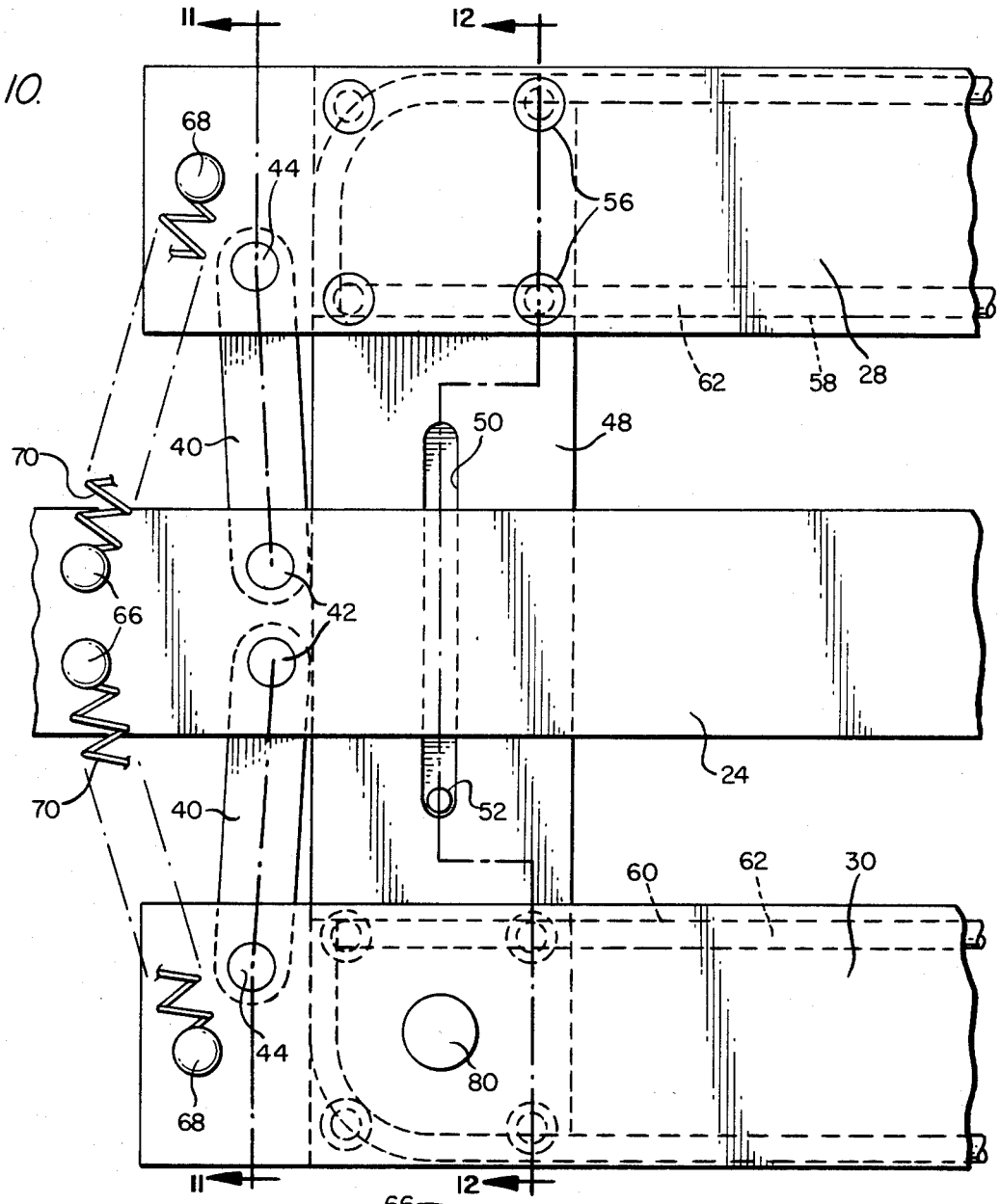
FIG. 10 is an enlarged side elevation of a segment of the hosiery form of FIG. 3 in expanded condition.

The action of the tension springs 70 in tending to urge the hosiery form 10 to either its expanded or its collapsed condition may be briefly described with reference to FIGS. 9 and 10. In the collapsed condition of hosiery form 10 where the leg members rest against the opposite sides of the central support rails 24 and 26, the angular relation between links 40 relative to the direction of forces applied by springs 70 is selected such that the overall spring force biases the leg members together with a slight holding force sufficient to retain the hosiery form 10 in this collapsed condition.

This relatively light holding force may be easily overcome by simply applying manual inward pressure tending to urge the tucking or crotch rod elements 58 and 60 together. A mere starting movement applied to the tucking elements 58 and 60 will initiate shifting of the hosiery form 10 toward its expanded condition. Continued and final shifting to the fully expanded condition can be augmented by camming means associated with the hosiery handling apparatus, if desired, as will be described.

Figure 6:
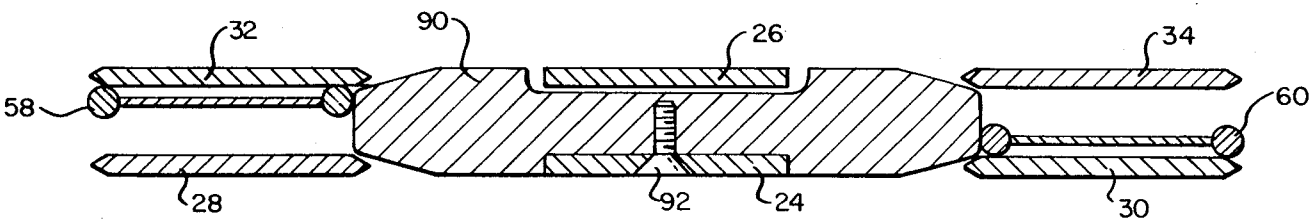
FIG. 6 is a sectional view taken on line 6—6 of FIG. 3.

Once the hosiery form 10 shifts to its expanded condition, such as shown in FIGS. 3 and 6, the position of links 40 will have moved to the condition where the underside of guide plates 46 and 48 rest against the ends of these links and the links will have moved over center. At this stage as will be clearly evident from FIGS. 3 and 6 the direction of biasing force applied by tension springs 70 is such as to hold the hosiery form 10 in this expanded condition. Of course, in expansion of the form 10 the tucking or crotch rod elements 58 and 60 will have drawn loose fabric existing in the body portion B of the panty garment into the space 36 between the legs of the hosiery form so that this body portion fabric is smooth and unwrinkled with slight stretching thereof in readiness for performance of the hosiery treatment operations to be carried out in the hosiery handling apparatus 12.

Reference was made above to utilization of cam means on the hosiery handling apparatus 12 to continue and assist in full shifting of the hosiery form 10 into its expanded condition. To perform this function the second elongated member 30 of one of the garment shaping legs may be suitably provided with an actuating pin 80. It will be understood that actuating pin 80 is so located on one of the leg members of the hosiery form 10 that when the form is mounted by means of pins 22 on its support base engaging the conveyor 14 of an appropriate hosiery handling apparatus 12, this pin 80 will move as the conveyor 14 carries it along into camming relation with an appropriate stationarily mounted cam C carried by the hosiery treating apparatus 12. In this way the interengagement between the actuating pin 80 on the collapsible hosiery form 10 and the inclined surface of stationary cam C will assure that the form 10 is fully actuated to its expanded condition. This mode of actuation may be easily visualized by reference to FIGS. 1 and 9 on the drawing.

In FIG. 1 the series of hosiery forms 10 are being conveyed by conveyor 14 through the hosiery handling apparatus 12 in the direction of the arrow on this Figure. As the actuating pin 80 on each form 10 moves into engagement with the stationary cam C the inclined surface of such cam assures that the second and trailing leg member of the form is shifted downwardly and outwardly such that the form is shifted into fully expanded condition. The relative directions of movement between the parts of form 10 and the hosiery handling apparatus 12 with its stationary cam C may also be easily visualized from the arrows appearing on FIG. 9.

It is pointed out that, whereas the hosiery form 10 may simply be expanded from its collapsed condition after a panty garment has been loaded thereon by the operator simply pressing against the sides of the tucking or crotch rod elements 58 and 60 without the utilization of the automatic actuation achieved by an actuating pin 80 on the form and a stationary cam C on the hosiery handling apparatus 12, the automatic operation is advantageous. The interaction between the actuating pin 80 and stationary cam C assure a positive automatic and full expansion of the hosiery form 10, thus assuring proper stretching, smoothing and wrinkle-free condition for the panty garment as it proceeds through the hosiery treating operations.

It may be noted that location of actuating pin 80 on the trailing or second member 30 of one of the garment shaping legs of form 10 is to be preferred. As may be easily visualized from FIGS. 1 and 13, with the relative movement between the parts shown thereon, the interengagement between pin 80 and the inclined surface of stationary cam C promotes the trailing second members of the garment shaping legs to move down and out away from the central support rails 24 and 26 on the hosiery form 10.

An advantageous feature for the hosiery form 10 is provided by a leg spreader cam block 90 which is secured by a single mounting screw 92 to the central support rail 24. Its interaction with the components of hosiery form 10 may best be envisioned by reference to FIGS. 4–8.

Figure 8:
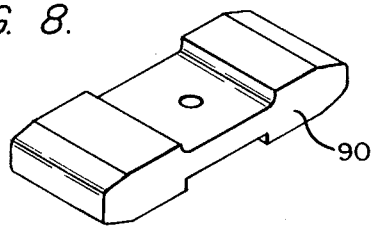
FIG. 8 is a perspective view of the leg spreader cam block.

The configuration of cam block 90 is seen in FIG. 8. It has oppositely directed tapering nose portions at its opposite ends with the body of the block 90 appropriately centrally grooved so that the central support rail 24 will snuggly fit in the groove of cam block 90. Then a single mounting screw 92 will suffice to firmly position block 90 at its desired location along the length of the central support rails 24 and 26, this location for block 90 being best seen on FIGS. 2 and 3.

The purpose of cam block 90 is to spread the parallel garment shaping legs provided by elongated members 28 and 30, and 32 and 34, respectively. Thus cam block 90 functions when the hosiery form 10 is collapsed as shown on FIG. 2 to spread the legs in the manner illustrated on FIG. 5. This spreading of the legs facilitates the ease with which an operator may individually load a panty garment onto hosiery form 10. It will be recognized that with the legs spread such as illustrated on FIG. 5 with their upper ends being spaced apart in the order of 4 inches, the operator in individually placing the panty hose leg portions on form 10 can more easily thread the garment onto the spaced garment shaping legs of the collapsed form 10.

On the other hand, once the garment is properly loaded onto the form and the form is expanded to its condition as shown in FIG. 3, then the legs move back to their parallel closely spaced condition as shown on FIG. 4.

Figure 7:
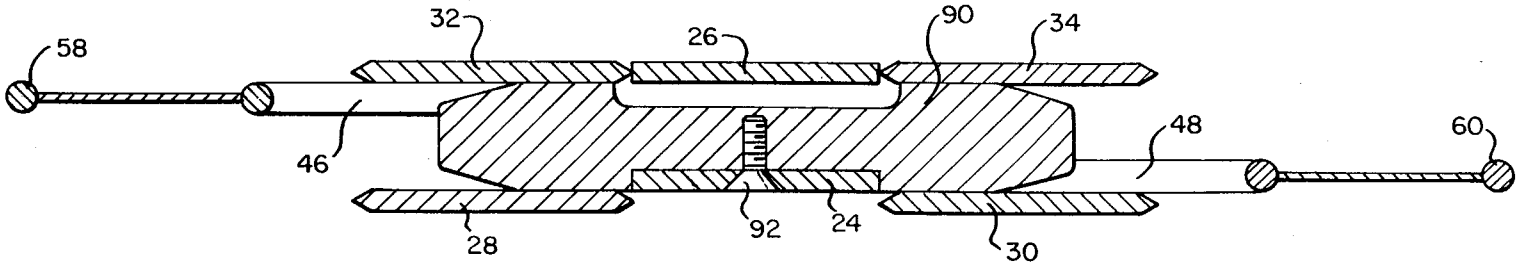
FIG. 7 is a sectional view taken on line 7—7 of FIG. 2.

FIG. 7 shows the relation of the nose portions of cam block 90 to the elongated leg members when the hosiery form is collapsed. In this state the tucking elements 58 and 60 are disposed outwardly from the leg members for the collapsed form to be easily loaded.

FIG. 6 shows the position of the cam block 90 when the hosiery form 10 is expanded. The nose portions of the cam block are free of the space between the elongated leg members allowing the members to resume their parallel closely spaced condition. Likewise the tucking elements 58 and 60 have moved into the space between the elongated members. Of course with the hosiery form expanded and the leg members back to their closely spaced relation the form carrying the garment loaded thereon is more compact and can be more easily transported through the hosiery treatment operations within the hosiery handling apparatus 12.

The construction of hosiery form 10 offers advantages to the operator to most effectively load a panty hose garment on the form. Form 10 is characterized by being shiftable between collapsed and expanded conditions having spaced garment shaping legs with garment fabric tucking means disposed outwardly of these legs in the collapsed condition of the form and disposed within the space between such legs in the expanded condition of the form. This interaction between the pair of garment shaping legs and garment fabric tucking means effectively assists the machine operator by enabling her to straighten and adjust the fabric of the leg and body portions while the hosiery form 10 is only partially expanded, but with the waistband area of the panty garment held by a relatively light retaining force applied incident shifting the hosiery form 10 toward its expanded condition.

More specifically, the operator in loading a panty hose garment on the collapsible hosiery form 10 will draw the garment down over the garment shaping legs with the form 10 in collapsed position. At this stage, each garment leg portion encloses one of the garment shaping legs of form 10 and the garment body portion B encircles both of these legs. In drawing the panty garment down over the form, the waistband area of the garment body B is positioned between the fabric tucking means, provided by tucking elements 58 and 60, and the spaced legs formed by elongated members 28–34 of the hosiery form 10. At this stage the fabric of the leg and body portions is loosely distributed over the collapsed form 10.

Then, by applying a light inward force to the outer sides of tucking elements 58 and 60, the operator initiates actuation of hosiery form 10 from its collapsed condition towards its expanded condition, this applied force overcoming the low biasing force of springs 70 that tends to keep form 10 collapsed. As the tucking elements 58 and 60 start to enter the space 36 between the garment shaping legs of form 10 they engage and immediately apply a retaining force to the waistband area of the garment body portion B. This retaining force provides an advantageous holding force such that the operator can then release her hold on the waistband area of the garment.

The slight retaining force offered by the tucking elements 58 and 60 sufficiently holds the waistband area to prevent the panty garment from undergoing its natural tendency to contract or spring back upwardly on form 10 as would happen if the form were still fully collapsed. Thus, with form 10 only in its partially expanded condition, the retaining force applied to the waistband area holds the panty garment so that the operator is free to straighten and adjust the fabric of the leg and body portions on the hosiery form where these fabric portions are loosely distributed over the collapsed form above the retained waistband area.

Once the operator has appropriately straightened and adjusted the fabric of the leg and body portions of the panty garment, as may be needed preliminary to full expansion of the hosiery form 10, the form can then be shifted to its fully expanded condition. When fully expanded, hosiery form 10 augments the retaining or holding force applied to the waistband area of the garment body portion B that was created by the form being in only partially expanded condition. Fully expanded form 10 also draws loose garment fabric into the space 36 between the spaced legs of the hosiery form such that the fabric of the legs and body portion B is smoothed and slightly stretched over the fully expanded form 10 in readiness for transport of the form with the panty garment loaded thereon through the desired hosiery treatment operations.

It will be recognized that shifting the hosiery form 10 from its partially expanded condition to its fully expanded condition may be easily carried out by the machine operator applying additional inward actuating force against the outer sides of the fabric tucking elements 58 and 60. However, preferably each form 10 will be shifted to its fully expanded condition automatically.

This automatic operation results from interaction between the actuation pin 80 on the form 10 and the inclined surface of stationary cam C mounted within the hosiery handling apparatus 12, all as described above in connection with automatic expansion of each hosiery form 10 as it moves through the loading station for panty garments. Obviously, successive automatic actuation of the hosiery forms 10 to their fully expanded conditions by interengagement between pins 80 and the inclined surface of stationary cam C is beneficial in that such automatic actuation immediately frees the operator to attend to loading another panty garment on the next following hosiery form 10 that is approaching the loading station in its fully collapsed condition.

Note may also be made that as best seen on FIGS. 11 and 13, a second actuating pin 82 may be provided on hosiery form 10. This actuating pin may easily be provided by extending one of the pins 68 which holds one end of a spring 70 on the first members 28 and 32 of the garment shaping legs. This actuating pin 82 extends from the opposite face of the hosiery form 10 relative to actuating pin 80. In hosiery handling apparatus 12 it is desirable that the collapsible hosiery forms 10 be automatically shifted to their collapsed condition as each of the hosiery forms moves in succession into a stripping station within the apparatus. A suitable stationary cam (not shown) would be provided at this stripping station of apparatus 12 such cam being disposed to engage the actuating pin 82 as the hosiery form 10 approaches this stationary cam in the stripping station. Then this stripping station cam, by its engagement with actuating pin 82, acts to shift the form leg members, overcoming the biasing force of springs 70, to thereby collapse the hosiery form 10 such that the treated panty garment may be easily stripped from the form. It will be recognized that the action of collapsing the hosiery form 10 automatically or otherwise causes the tucking or crotch rod elements 58 and 60 to shift out of the space 36 between the garment shaping legs and come to rest spaced from the sides of such legs such as shown in FIG. 2 where the panty garment is totally freed for stripping from the hosiery form 10.

As known in the prior art, after garment stripping the collapsed and stripped forms 10 are successively conveyed back into the loading station which they enter in the condition shown for the right form 10 on FIG. 1.

While a preferred embodiment of the invention has been disclosed in detail hereinabove it will be apparent to those skilled in the art that the disclosed embodiment may be modified and varied within a wide range of structural details all possible and recognizable within the spirit of the invention herein. Therefore, the foregoing description and accompanying drawings are to be considered only as exemplary and not limiting, the true scope of the invention being defined and established by the appended claims.

I claim:

1. A collapsible hosiery form such as employed in hosiery treatment operations for panty hose garments and the like comprising:

a support base having means for supporting said form in hosiery treatment operations;

a pair of generally parallel garment shaping legs extending from said base to define a space between said legs, each of said legs including first and second elongated members;

means mounting said first and second members of each said leg on said support base for said members to undergo substantially translational movement relative to each other between an expanded condition and a collapsed condition for the leg; and garment fabric tucking means extending from said support base in association with said legs to draw loose fabric into said space between said legs when said elongated members are moved into said expanded condition.

2. A collapsible hosiery form as recited in claim 1 wherein leg spreader cam means is carried by said support base, said spreader cam means engaging in said space between said garment shaping legs when said legs are in said collapsed condition to spread said legs apart for ease of garment loading.

3. A collapsible hosiery form as recited in claim 1 wherein said tucking means comprises at least one tucking element mounted relative to said support base to extend generally parallel to said garment shaping legs, said tucking element being disposed outwardly of said space between said legs when said elongated members are in said collapsed condition and disposed within said space when said elongated members are in said expanded condition.

4. A collapsible hosiery form as recited in claim 1 wherein said tucking means comprises at least one tucking element connected to move with one of said elongated members of one of said legs.

5. A collapsible hosiery form as recited in claim 1 wherein said tucking means comprises a first tucking element connected to move with said first elongated member of one of said legs and a second tucking element connected to move with said second elongated member of the other of said legs.

6. A collapsible hosiery form as recited in claim 1 wherein spring means is connected between said leg members and said support base acting to bias said members alternatively to said expanded or collapsed conditions.

7. A collapsible hosiery form as recited in claim 1 wherein said base has a central support extending therefrom, said garment shaping legs extend along opposite sides of said support, and said mounting means is provided by link means pivotally connected between said central support and said leg members, respectively, to constrain said members to undergo translational movement relative to said central support.

8. A collapsible hosiery form as recited in claim 7 wherein leg spreader cam means is carried by said central support of said base, said spreader cam means engaging in said space between said garment shaping legs when said legs are in said collapsed condition to spread said legs apart for ease of garment loading.

9. A collapsible hosiery form as recited in claim 7 wherein said tucking means includes a tucking element extending generally parallel to said leg members, said element being supported on a guide plate which extends through an aperture in said central support with the end of said plate secured to one of said leg members at the opposite side of said central support.

10. A collapsible hosiery form as recited in claim 9 wherein each of said legs has a tucking element associated therewith.

11. A collapsible hosiery form as recited in claim 9 wherein a pair of guide plates extend through said central support aperture, each said plate supporting a tucking element at one end thereof with the other plate end being secured to one of said leg members at the opposite side of said central support.

12. A collapsible hosiery form as recited in claim 11 wherein said guide plates are slidably interengaged with one of said plates having an elongated guide slot and the other of said plates carrying a guide stud engaged in said guide slot to control sliding movement between said plates during expansion and collapse of said hosiery form.

13. A collapsible hosiery form as recited in claim 11 wherein spring means is connected between said leg members and said support base acting to bias said members alternatively to said expanded or collapsed conditions.

14. A collapsible hosiery form as recited in claim 1 wherein actuating means for said form is associated with said leg members to be engageable in effecting expansion and collapse of said hosiery form in movement of said form through hosiery treatment operations.

15. A collapsible hosiery form as recited in claim 14 wherein said first elongated members of said pair of legs and said second elongated members of said pair of legs are connected to move in unison, respectively, between expanded and collapsed conditions for said legs, and said actuating means includes a first actuating pin carried by said first elongated member of one of said legs and a second actuating pin carried by said second elongated member of the other of said legs, said pins being engageable by stationary cam means in movement through hosiery treatment operations to effect collapse and expansion of said hosiery form.

* * * * *